US009402479B1

(12) United States Patent
Lin

(10) Patent No.: US 9,402,479 B1
(45) Date of Patent: Aug. 2, 2016

(54) LEISURE CHAIR WITH A FOOTREST UNIT

(71) Applicant: Chang-Chen Lin, Tainan (TW)

(72) Inventor: Chang-Chen Lin, Tainan (TW)

( * ) Notice: Subject to any disclaimer, the term of this patent is extended or adjusted under 35 U.S.C. 154(b) by 0 days.

(21) Appl. No.: 14/840,034

(22) Filed: Aug. 30, 2015

(51) Int. Cl.
*A47C 1/035* (2006.01)

(52) U.S. Cl.
CPC ..... *A47C 1/035* (2013.01)

(58) Field of Classification Search
CPC ..... A47C 1/035
USPC ..... 297/76, 85 L
See application file for complete search history.

(56) References Cited

U.S. PATENT DOCUMENTS 8,882,190 B2 * 11/2014 Garland ..... A47C 1/0342 297/85 L
8,967,718 B2 * 3/2015 Hoffman ..... A47C 1/0355 297/259.2
9,022,473 B2 * 5/2015 Crum ..... A47C 1/0355 297/85 L
9,351,574 B2 * 5/2016 Lin ..... A47C 1/0355 297/85 L

* cited by examiner

*Primary Examiner* — Anthony D Barfield

(57) ABSTRACT

A leisure chair includes a seat movably mounted on top of a base. The seat includes a front rod extending between two lateral rods. A backrest is connected to the rear side of the seat. A footrest unit includes at least one first link and at least one second link. Forward movement of the seat causes the at least one first link and the at least one second link to pivot and causes the footrest unit to fold and move to the storage position below the seat. The at least one first link and the at least one second link form a folded part of the footrest unit. Rearward movement of the seat causes the at least one first link and the at least one second link to pivot and extend and causes the footrest to extend and move to the extended position in front of the seat.

10 Claims, 6 Drawing Sheets

LEISURE CHAIR WITH A FOOTREST UNIT

BACKGROUND OF THE INVENTION

The present invention relates to a leisure chair with a footrest unit and, more particularly, to a leisure chair including a footrest unit that has a reduced volume in a store position, has a larger span in an extended position, and provides more stable operation.

A type of conventional chairs includes a footrest for supporting the calves of a user to increase the sitting comfort, and the footrest can be moved between an extended position and a storage position to provide convenience use to the user.

A conventional footrest is generally mounted below a front end of a seat of a chair and is generally perpendicular to the seat in the storage position. The footrest can be pivoted to a position substantially parallel to the seat. An example of such a footrest is disclosed in U.S. Pat. Nos. 6,572,185; 7,134,713; and 6,402,232. However, the footrest is limited by the height of the seat from the ground, leading to insufficient extended length of the footrest.

In an arrangement, the footrest can be extended when a backrest of the chair is moved. However, the footrest cannot be moved to the extended position when the backrest is not moved to in a rearward inclination position. In another arrangement, movement between the extended position and the storage position of the footrest can be achieved by a control rod that cannot be operated conveniently while increasing the costs.

BRIEF SUMMARY OF THE INVENTION

An objective of the present invention is to provide leisure chair including a footrest unit that has a reduced volume in a store position, has a larger span in an extended position, and provides more stable operation.

A leisure chair with a footrest unit according to the present invention includes a base adapted to be placed on a ground. The base includes a horizontal rod having two ends spaced from each other in a width direction. The horizontal rod includes a front supporting portion extending forwards from the horizontal rod and located between the two ends of the horizontal rod. An armrest is adapted to be mounted to each of the two ends of the horizontal rod. A seat is mounted on top of the base and includes a front side and a rear side. The seat includes two lateral rods spaced from each other in the width direction and a front rod extending between the two lateral rods. The seat is movable relative to the base in a forward/rearward direction perpendicular to the width direction between a front position and a rear position. A backrest is connected to the rear side of the seat. A footrest unit is movable between a storage position and an extended position spaced from the storage position in the forward/rearward direction. The footrest unit includes at least one first link, at least one second link, a first pivotal frame, a third link, a second pivotal frame, at least one fourth link, and at least one connection frame. Each of the at least one first link and the at least one second link is pivotably connected to a front end of the front supporting portion. A front side of the first pivotal frame in the storage position is pivotably connected to the at least one first link, the at least one second link, and the front side of the seat. A front end of the third link in the storage position is pivotably connected to the front side of the seat. A rear side of the second pivotal frame in the storage position is pivotably connected to a rear side of the first pivotal frame and a rear end of the third link. A rear end of the at least one fourth link in the storage position is pivotably connected to the rear side of the first pivotal frame. A front side of the at least one connection frame in the storage position is pivotably connected to a front side of the second pivotal frame. A rear side of the at least one connection frame in the storage position is pivotably connected to a front end of the at least one fourth link.

Forward movement of the seat causes the at least one first link and the at least one second link to pivot and causes the footrest unit to fold and move to the storage position below the seat. The at least one first link and the at least one second link form a folded part of the footrest unit.

Rearward movement of the seat causes the at least one first link and the at least one second link to pivot and extend and causes the footrest to extend and move to the extended position in front of the seat.

In an example, the front supporting portion of the base includes two front posts. The at least one first link includes two first links pivotably connected to front ends of the two front posts, respectively. The at least one second link including two second links pivotably connected to the front ends of the two front posts, respectively. The first pivotal frame has a width in the width direction smaller than a spacing between the two front posts in the width direction. The second pivotal frame has a width in the width direction smaller than the width of the first pivotal frame. Each of the two front posts of the base can have a length in the forward/rearward direction larger than a half of a length of the seat in the forward/rearward direction. The first pivotal frame can have a length in the forward/rearward direction approximately equal to the length of each of the two front posts.

The leisure chair can further include two pivotal columns. Each of the two pivotal columns has an upper end and a lower end. Each of the two ends of the horizontal rod of the base can include a pivotal seat pivotably connected to the lower end of one of the two pivotal columns. Each pivotal seat includes a stop portion on a rear side thereof. The stop portion of each pivotal seat limits a rearward pivotal angle of one of the two pivotal columns. The upper end of each of the two pivotal columns is pivotably connected to the rear side of the seat.

The leisure chair can further at least one elastic element mounted between the seat and the base. The at least one elastic element provides a returning force for returning the seat to the front position.

The backrest can be pivotably connected to the seat. A telescopic rod can be mounted between the backrest and the seat to permit control of a rearward inclination angle of the backrest.

In an example, each of the two front posts includes a front end having a first pivotal portion and a second pivotal portion spaced from the first pivotal portion in a vertical direction perpendicular to the forward/rearward direction and the width direction. The front rod of the seat includes two fourth pivotal portions. The front rod further includes a seventh pivotal portion. The at least one first link of the footrest unit includes two first links pivotably connected to the front ends of the two front posts, respectively. Each of the two first links includes two ends respectively having an eleventh pivotal portion and a twelfth pivotal portion. Each eleventh pivotal portion is pivotably connected to one of the two second pivotal portions of the base. Each twelfth pivotal portion is pivotably connected to one of the fourth pivotal portions of the seat. The at least one second link of the footrest unit includes two second links pivotably connected to the front ends of the two front posts, respectively. Each of the two second links includes two ends respectively having a thirteenth pivotal portion and a fourteenth pivotal portion. Each thirteenth pivotal portion is pivotably connected to one of the first pivotal portions of the base. The first pivotal frame of the footrest unit has a width in the width direction smaller than a spacing between the two front posts in the width direction. The first pivotal frame includes two first lateral beams parallel to each other and a first horizontal beam extending between the two first lateral beams. Each of the two first lateral beams has a length in the forward/rearward direction approximately equal to of the length of each of the two front posts. The two first lateral beams are symmetric to each other. Each of the two first lateral beams in the storage position includes fifteenth, sixteenth, seventeenth, and eighteenth pivotal portions arranged in sequence from a front end thereof to a rear end thereof spaced from the front end in the forward/rearward direction. Each fifteenth pivotal portion is pivotably connected to one of the fourth pivotal portions of the seat and the twelfth pivotal portion of one of the two first links. Each sixteenth pivotal portion is pivotably connected to the fourteenth pivotal portion of one of the two second links. The third link in the storage position includes a nineteenth pivotal portion at the front end thereof and a twentieth pivotal portion at the rear end thereof. The nineteenth pivotal portion is pivotably connected to the seventh pivotal portion of the seat. The second pivotal frame includes two second lateral beams parallel to each other and a second horizontal beam connected between two ends respectively of the two second lateral beams. The second pivotal frame has a width in the width direction smaller than a spacing between the two first lateral beams of the first pivotal frame in the width direction. Each of the two second lateral beams in the storage position includes a front end having a twenty-first pivotal portion and a second end having a twenty-second pivotal portion. The second horizontal beam includes a twenty-third pivotal portion. Each twenty-second pivotal portion is pivotably connected to one of the seventeenth pivotal portions of the first pivotal frame. The twenty-third pivotal portion is pivotably connected to the twentieth pivotal portion of the third link. The at least one fourth link includes two fourth links. Each of the two fourth links in the storage position includes a front end having a twenty-fourth pivotal portion and a rear end having a twenty-fifth pivotal portion. Each twenty-fourth pivotal portion is pivotably connected to one of the eighteenth pivotal portions of the first pivotal frame. The at least one connection frame includes two connection frames. Each of the two connection frames in the storage position includes a front end having a twenty-sixth pivotal portion and a rear end having a twenty-seventh pivotal portion. Each twenty-sixth pivotal portion is pivotably connected to one of the twenty-first pivotal portions of the second pivotal frame. Each twenty-seventh pivotal portion is pivotably connected to the twenty-fifth pivotal portion of one of the two fourth links.

In an example, a sideboard is mounted to each of the two ends of the horizontal rod of the base. Each armrest is adapted to be mounted to one of the sideboards of the base. Each of the two ends of the horizontal rod of the base includes a pivotal seat having a compartment and a third pivotal portion. A lower end of each of the two pivotal columns is pivotably connected to the third pivotal portion of one of the pivotal seats. Each pivotal seat includes a stop portion on a rear side thereof. The stop portion of each pivotal seat limits a rearward pivotal angle of one of the two pivotal columns. Each of the two lateral rods of the seat includes a fifth pivotal portion pivotably connected to an upper end of one of the two pivotal columns. When the seat moves forwards, the front side of the seat presses against the two front posts of the front supporting portion, and the two pivotal columns are substantially perpendicular to the ground. When the seat moves rearwards, the two pivotal columns abut against the stop portions. The at least one elastic element includes two springs. Each of the two lateral rods of the seat includes a peg in front of one of the fifth pivotal portions. Each of the two springs includes two ends mounted to one of the pegs of the seat and one of the sideboards of the base.

The present invention will become clearer in light of the following detailed description of illustrative embodiments of this invention described in connection with the drawings.

DETAILED DESCRIPTION OF THE INVENTION

Figure 1:
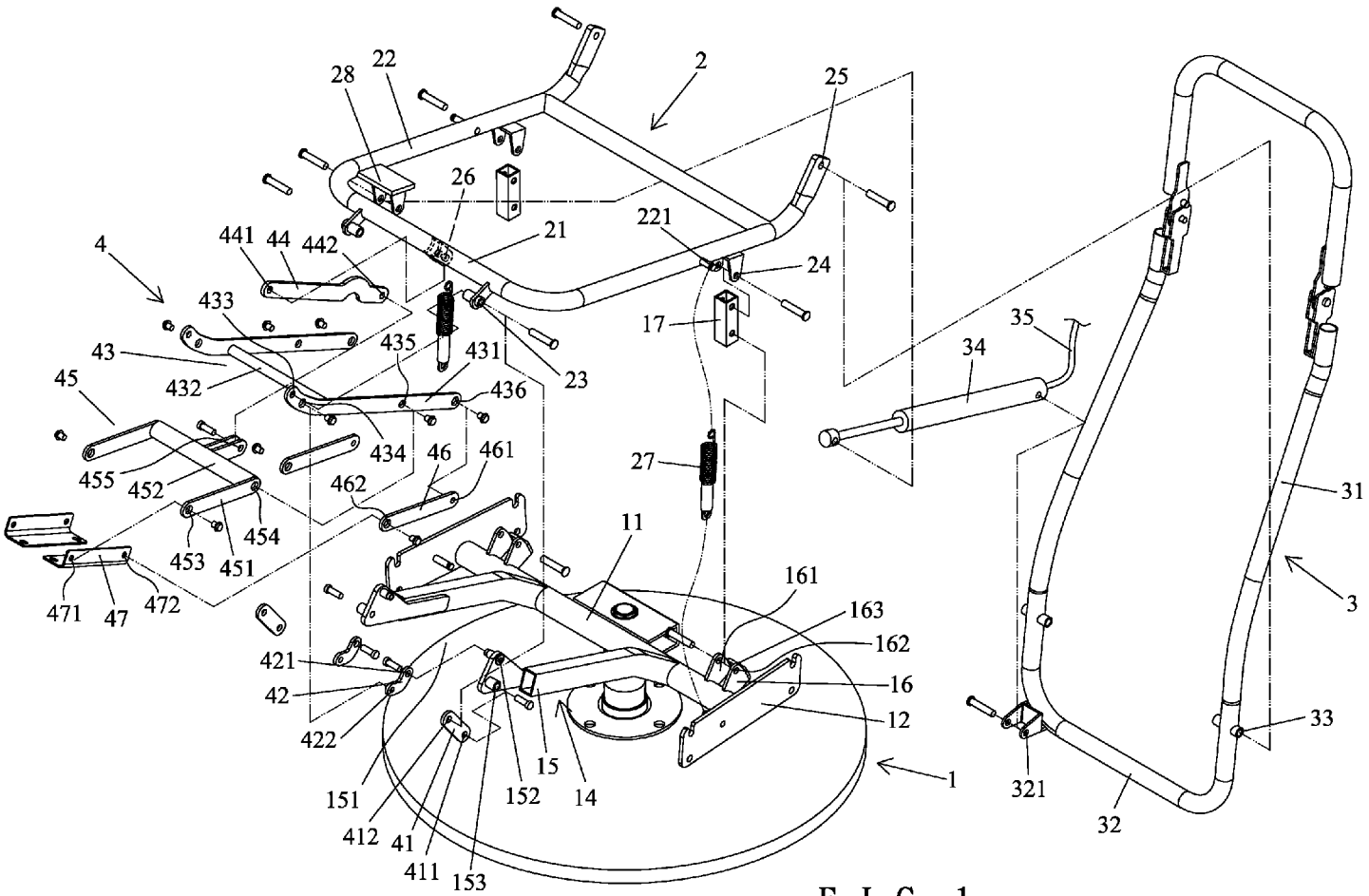
FIG. 1 is an exploded, perspective view of a leisure chair according to the present invention, with two armrests and a control rod of a control device removed for clarity.
Figure 2:
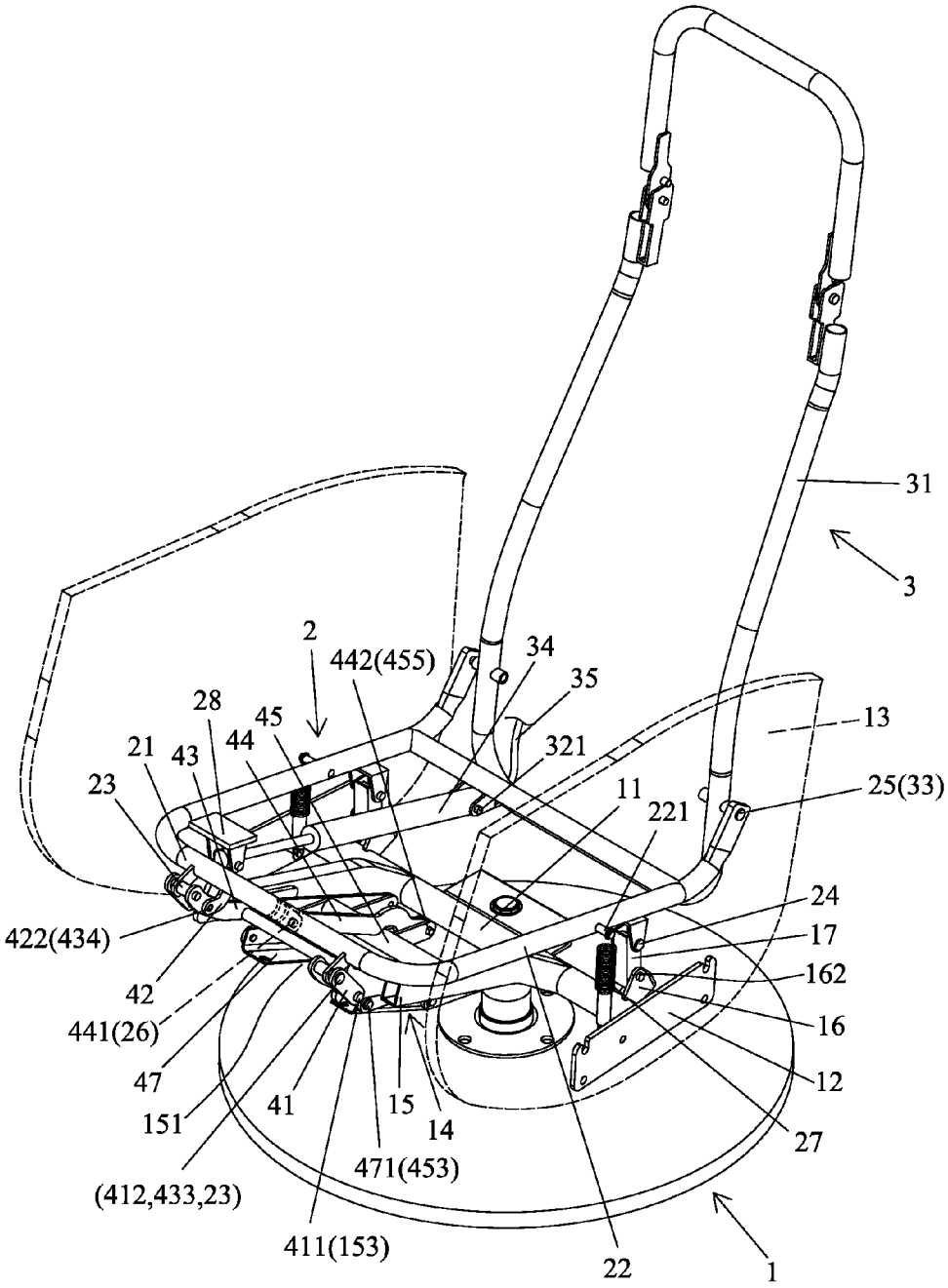
FIG. 2 is a perspective view of the leisure chair according to the present invention in a storage stage.
Figure 3:
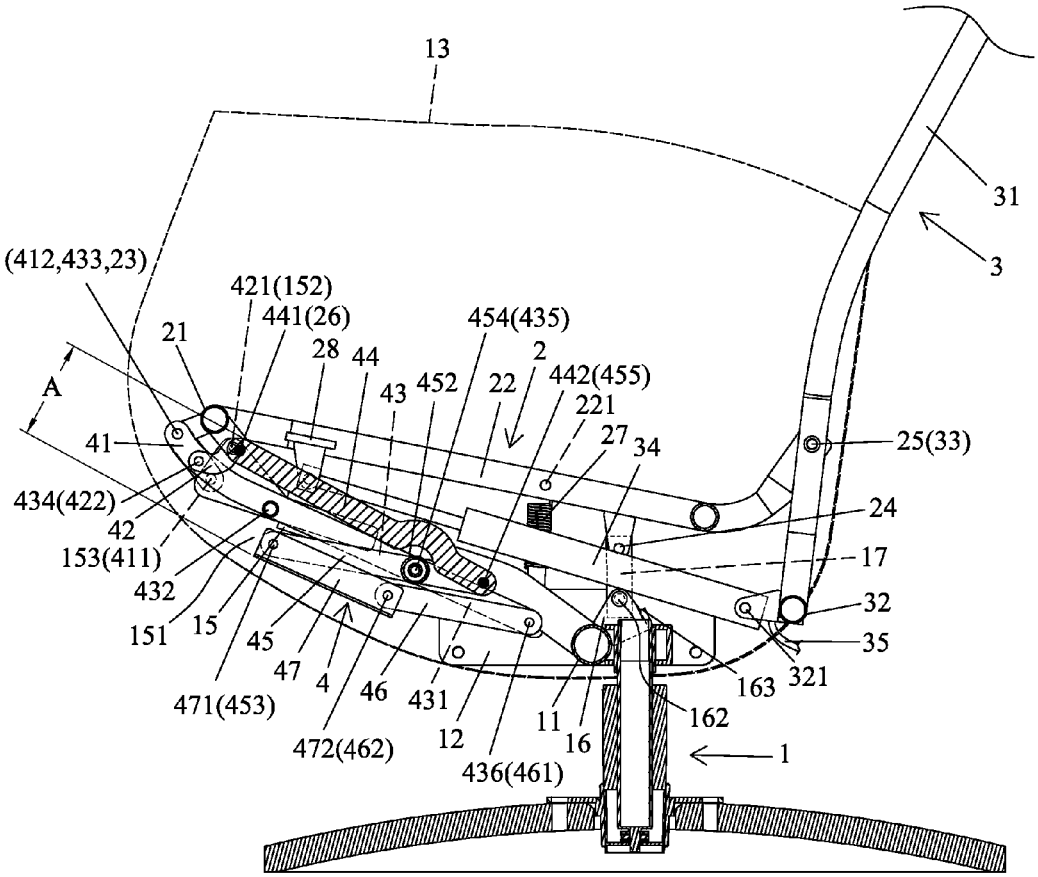
FIG. 3 is a partially cross sectioned side view of the leisure chair according to the present invention.

With reference to FIGS. 1-3, a leisure chair with a footrest according to the present invention includes a base 1, a seat 2, a backrest 3, and a footrest unit 4. The base 1 is adapted to be placed on a ground. The base 1 includes a horizontal rod 11 having two ends spaced from each other in a width direction. A sideboard 12 is mounted to each end of the horizontal rod 11 of the base 1. An armrest 13 is adapted to be mounted to one of the sideboards 12 of the base 1. A front supporting portion 14 extending forwards from the horizontal rod 11 and is located between the two ends of the horizontal rod 11. The front supporting portion 14 of the base 1 includes two front posts 15 having a suitable length. In the form shown, the length of each of the two front posts 15 in the forward/rearward direction is larger than a half of a length of the seat 2 in the forward/rearward direction. Furthermore, each of the two front posts 15 extends upwards and forwards away from the ground. A receiving space 151 is defined between the front supporting portion 14 and a bottom of the base 1. Each of the two front posts 15 includes a front end having a first pivotal portion 152 and a second pivotal portion 153 spaced from the first pivotal portion 152 in a vertical direction perpendicular to the forward/rearward direction and the width direction. Each of the two ends of the horizontal rod 11 of the base 1 further includes a pivotal seat 16 having a compartment 161 and a third pivotal portion 162. A lower end of each of two pivotal columns 17 is pivotably connected to the third pivotal portion 162 of one of the pivotal seats 16. Each pivotal seat 16 further includes a stop portion 163 on a rear side thereof. The stop portion 163 of each pivotal seat 16 limits a rearward pivotal angle of one of the two pivotal columns 17.

The seat 2 is mounted on top of the base 1 and is movable relative to the base 1 in the forward/rearward direction perpendicular to the width direction between a front position and a rear position. The seat 2 includes a front side and a rear side. The seat 2 includes two lateral rods 22 spaced from each other in the width direction and a front rod 21 extending between the two lateral rods 22. The front rod 21 of the seat 2 includes two fourth pivotal portions 23. Each of the two lateral rods 22 of the seat 2 includes a fifth pivotal portion 24 pivotably connected to an upper end of one of the two pivotal columns 17. The rear end of each of the two lateral rods 22 includes a sixth pivotal portion 25. The front rod 21 further includes a seventh pivotal portion 26. At least one elastic element 27 is mounted between the seat 2 and the base 1 to provide a returning force for returning the seat 2 to the front position. In the form shown, two elastic elements 27 are provided. Each of the two lateral rods 22 of the seat 2 includes a peg 221 in front of one of the fifth pivotal portions 24. Each of the two elastic elements 27 includes two ends mounted to one of the pegs 221 of the seat 2 and one of the sideboards 12 of the base 1. The front rod 21 further includes an eighth pivotal portion 28.

The backrest 3 is connected to the rear side of the seat 2. The backrest 3 includes two lateral rods 31 and a bottom rod 32 extending between the two lateral rods 31. Each lateral rod 31 includes a ninth pivotal portion 33 pivotably connected to one of the two sixth pivotal portions 25 of the seat 2, permitting the backrest 3 to pivot relative to the seat 2. The bottom rod 32 includes a tenth pivotal portion 321. A telescopic rod 34 includes a first end pivotably connected to the eighth pivotal portion 28 of the seat 2 and a second end pivotably connected to the tenth pivotal portion 321 of the backrest 3. A control device 35 is provided to control a length of the telescopic rod 34 and the rearward inclination angle of the backrest 3. The telescopic rod 34 can be manually or electrically operated. A control cable of the control device 35 is shown, but control elements of the control device 35 are not shown.

The footrest unit 4 is movable between a storage position and an extended position spaced from the storage position in the forward/rearward direction. In the form shown, the footrest unit 4 includes two first links 41, two second links 42, a first pivotal frame 43, a third link 44, a second pivotal frame 45, two fourth links 46, and two connection frames 47.

Each of the first links 41 is pivotably connected to a side of the front end of one of the two front posts 15. Each of the two first links 41 includes two ends respectively having an eleventh pivotal portion 411 and a twelfth pivotal portion 412. Each eleventh pivotal portion 411 is pivotably connected to one of the two second pivotal portions 153 of the base 1. Each twelfth pivotal portion 412 is pivotably connected to one of the fourth pivotal portions 23 of the seat 2.

Each of the two second links 42 is pivotably connected to the other side of the front end of one of the two front posts 15 opposite to the associated first link 41. Each of the two second links 42 includes two ends respectively having a thirteenth pivotal portion 421 and a fourteenth pivotal portion 422. Each thirteenth pivotal portion 421 is pivotably connected to one of the first pivotal portions 152 of the base 1.

The first pivotal frame 43 includes two first lateral beams 431 parallel to each other and a first horizontal beam 432 extending between the two first lateral beams 431. The first pivotal frame 43 has a width in the width direction smaller than a spacing between the two front posts 15 in the width direction. Each of the two first lateral beams 431 has a length in the forward/rearward direction approximately equal to of the length of each of the two front posts 15 to provide a larger span when the footrest unit 4 is in the extended position. The two first lateral beams 431 are symmetric to each other. Each of the two first lateral beams 431 in the storage position includes fifteenth, sixteenth, seventeenth, and eighteenth pivotal portions 433, 434, 435, and 436 arranged in sequence from a front end thereof to a rear end thereof spaced from the front end in the forward/rearward direction. Each fifteenth pivotal portion 433 is pivotably connected to one of the fourth pivotal portions 23 of the seat 2 and the twelfth pivotal portion 412 of one of the two first links 41. Each sixteenth pivotal portion 434 is pivotably connected to the fourteenth pivotal portion 422 of one of the two second links 42.

The third link 44 in the storage position includes a nineteenth pivotal portion 441 at a front end thereof and a twentieth pivotal portion 442 at a rear end thereof. The nineteenth pivotal portion 441 is pivotably connected to the seventh pivotal portion 26 of the seat 2.

The second pivotal frame 45 includes two second lateral beams 451 parallel to each other and a second horizontal beam 452 connected between two ends respectively of the two second lateral beams 451. The second pivotal frame 45 has a width in the width direction smaller than a spacing between the two first lateral beams 431 of the first pivotal frame 43 in the width direction. Each of the two second lateral beams 451 in the storage position includes a front end having a twenty-first pivotal portion 453 and a second end having a twenty-second pivotal portion 454. The second horizontal beam 452 includes a twenty-third pivotal portion 455. Each twenty-second pivotal portion 454 is pivotably connected to one of the seventeenth pivotal portions 435 of the first pivotal frame 43. The twenty-third pivotal portion 455 is pivotably connected to the twentieth pivotal portion 442 of the third link 44.

Each of the two fourth links 46 in the storage position includes a front end having a twenty-fourth pivotal portion 461 and a rear end having a twenty-fifth pivotal portion 462. Each twenty-fourth pivotal portion 461 is pivotably connected to one of the eighteenth pivotal portions 436 of the first pivotal frame 43.

The two connection frames 47 are mounted relative to each other. Each of the two connection frames 47 in the storage position includes a front end having a twenty-sixth pivotal portion 471 and a rear end having a twenty-seventh pivotal portion 472. Each twenty-sixth pivotal portion 471 is pivotably connected to one of the twenty-first pivotal portions 453 of the second pivotal frame 45. Each twenty-seventh pivotal portion 472 is pivotably connected to the twenty-fifth pivotal portion 462 of one of the two fourth links 46. A soft pad (not shown) can be mounted on top of the connection frames 47.

When the footrest unit 4 is not extended, the footrest unit 4 is pulled and positioned by the elastic elements 27 of the seat 2. When the footrest unit 4 is folded, the first links 41 and the second links 42 are pivoted and, thus form a folded part of the footrest 4 relative to the base 1. Thus, the footrest unit 4 can be received in the receiving space 151 and between the two front posts 15. Furthermore, the second pivotal frame 45 is received between the two first lateral beams 431 of the first pivotal frame 43. As a result, the footrest unit 4 can be folded and stored. The overall thickness A (FIG. 3) of the footrest unit 4 in the storage position is reduced, providing a sense of quality. Furthermore, when a user sits in the seat 2, the front side of the seat 2 presses against the front posts 15 of the supporting portion 14, and the two pivotal columns 17 are substantially perpendicular to the ground to provide a stable supporting effect. At this time, the control device 35 can be operated to control the telescopic rod 34 for adjusting the rearward inclination angle of the backrest 3 (not shown).

Figure 4:
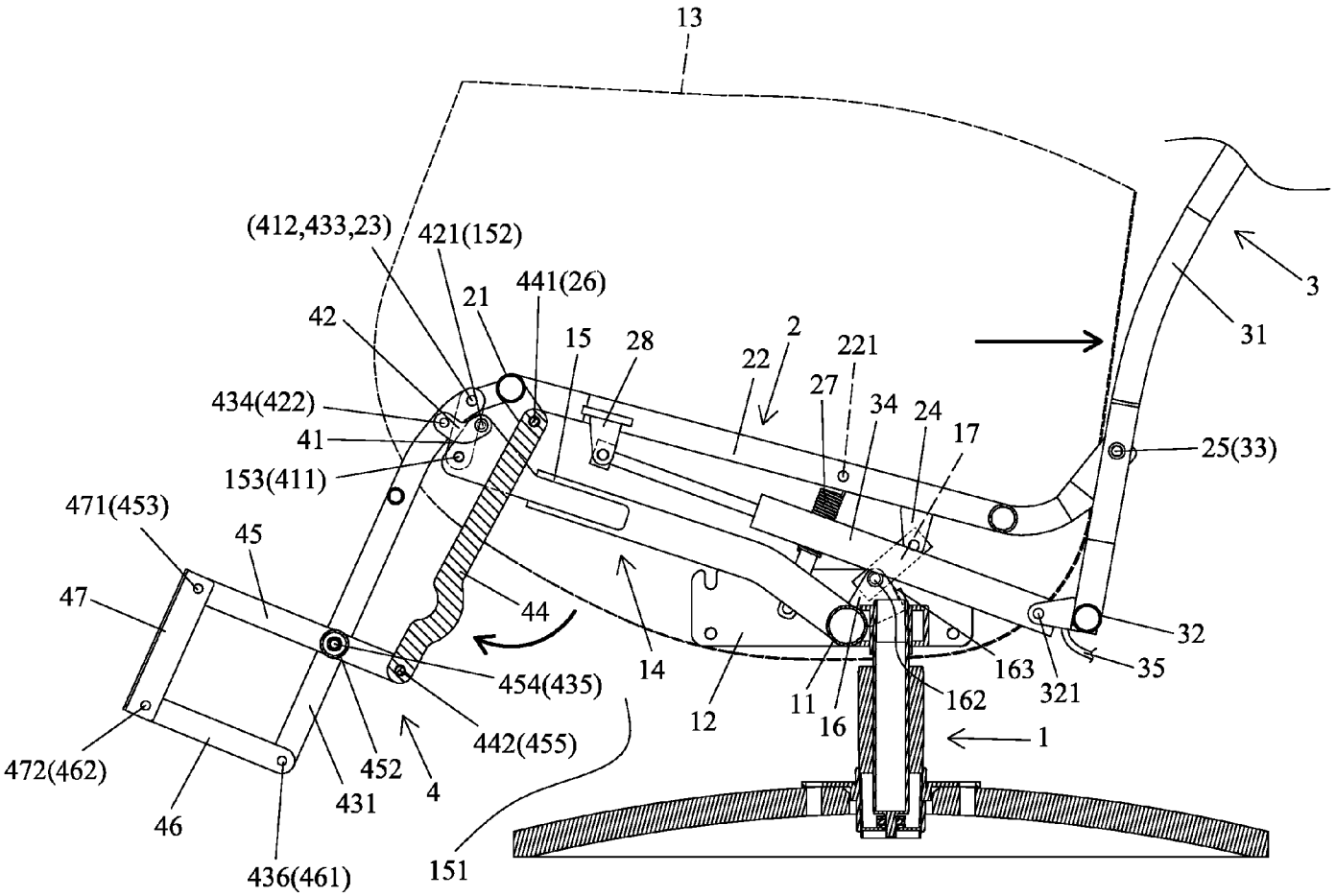
FIG. 4 is a view similar to FIG. 3 with a seat moved rearwards.
Figure 5:
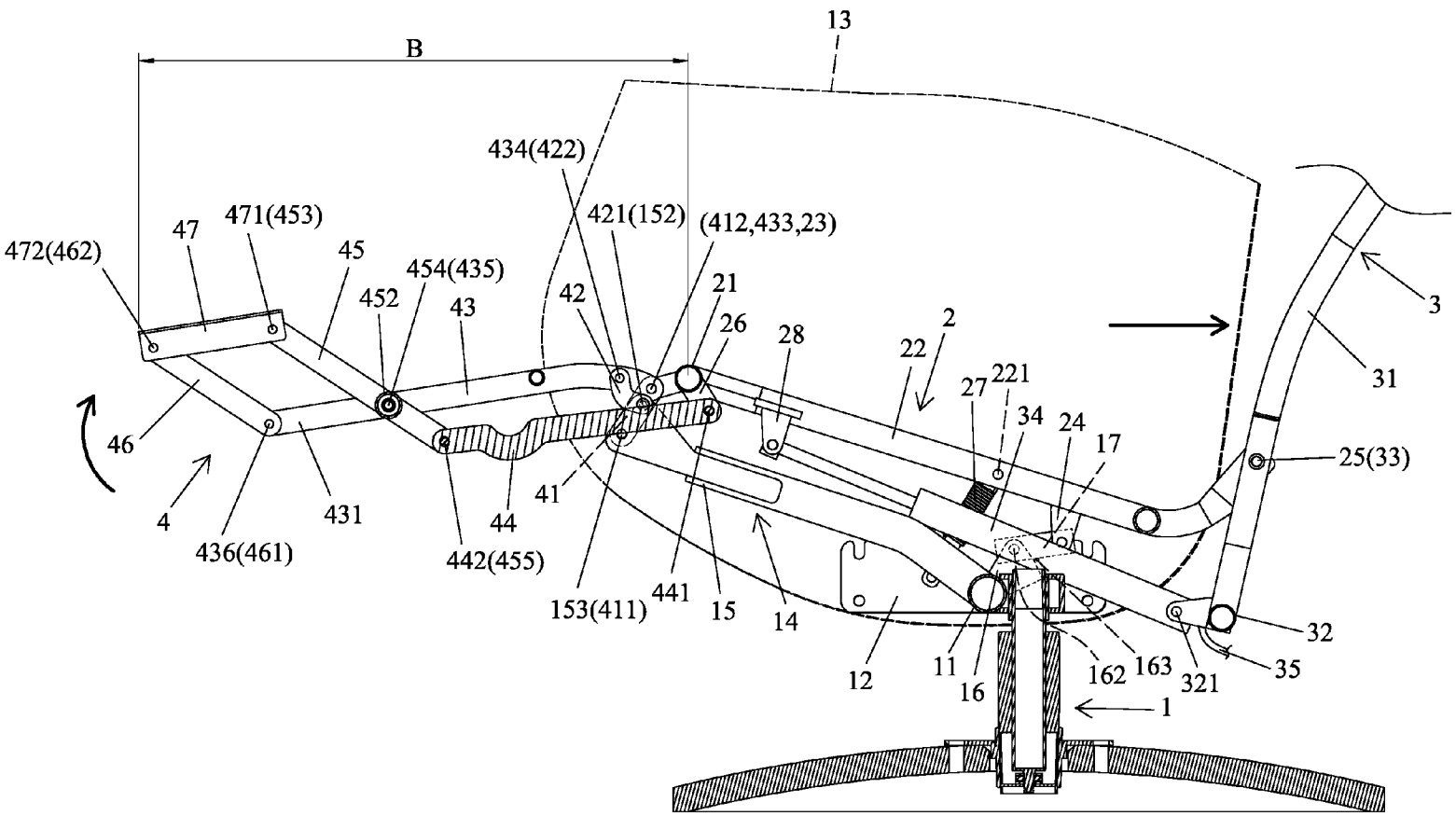
FIG. 5 is a view similar to FIG. 3 with the seat moved rearwards and with a footrest unit extended.
Figure 6:
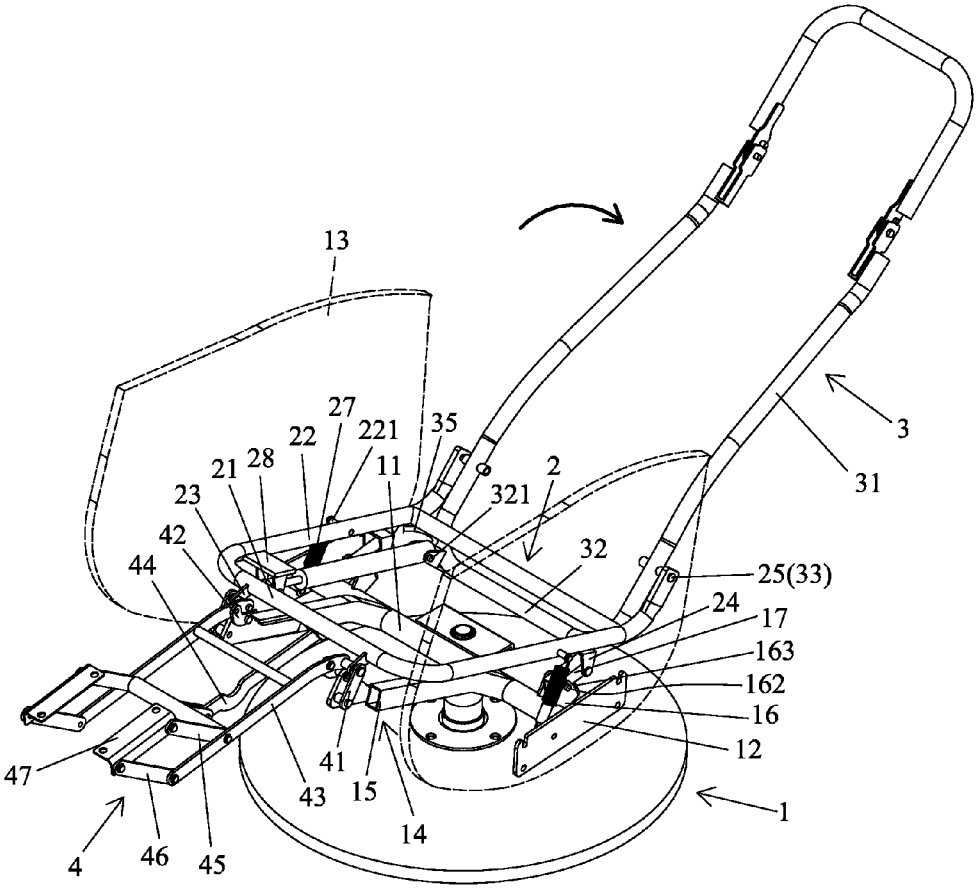
FIG. 6 is a perspective view of the leisure chair according to the present invention, with the seat moved rearwards, with the footrest unit extended, and with a backrest inclined rearwards.

With reference to FIGS. 4-6, when the user holds the armrests 13 and moves his or her buttocks rearwards to apply a force moving the seat 2 rearwards relative to the base, the footrest unit 4 is extended and moves from the storage position to the extended position. During the movement of the footrest unit 4, the upper ends of the pivotal columns 17 move rearward, abut against the stop portions 163 of the base 1, and are stopped and positioned by the stop portions 163 while stretching the elastic elements 27. During the rearward movement of the seat 2, the first and second links 41 and 42 pivot about the front supporting portion 14 of the base 1 to cause forward extension of the first pivotal frame 43 while causing upward extension of the second pivotal frame 45, the second links 46, and the connection frames 47. The whole span B of the footrest unit 4 in the extended position shown in FIG. 5 is larger than the length of the first pivotal frame 43 to provide better supporting comfort for the calves of the user. In this case, the user can also use the control device 35 to control the length of the telescopic rod 34 and the rearward inclination angle of the backrest 3, as shown in FIG. 6.

When it is desired to fold the footrest unit 4 again, the use can use the legs to apply a downward force to fold the footrest 4 and to move the seat 2 forward to a state shown in FIG. 3. The returning force of the elastic elements 27 provides easy, convenient folding. Operation of the footrest unit 4 does not require any other control rod.

In view of the foregoing, the footrest unit 4 of the leisure chair in the storage position has a reduced volume to provide a sense of quality. Furthermore, the footrest unit 4 of the leisure chair in the extended position has a larger span to provide increased supporting comfort for the legs of the user. Furthermore, the operation is more stable. Furthermore, the footrest unit 4 is not operatively connected to the backrest 3, such that the leisure chair does not have to include the telescopic rod 34 if adjustment of the inclination angle of the backrest 3 is not required.

Although specific embodiments have been illustrated and described, numerous modifications and variations are still possible without departing from the scope of the invention. The scope of the invention is limited by the accompanying claims.

The invention claimed is:

1. A leisure chair with a footrest unit, comprising:

a base adapted to be placed on a ground, with the base including a horizontal rod having two ends spaced from each other in a width direction, with the horizontal rod including a front supporting portion extending forwards from the horizontal rod and located between the two ends of the horizontal rod, and with an armrest adapted to be mounted to each of the two ends of the horizontal rod;

a seat mounted on top of the base and including a front side and a rear side, with the seat including two lateral rods spaced from each other in the width direction and a front rod extending between the two lateral rods, and with the seat movable relative to the base in a forward/rearward direction perpendicular to the width direction between a front position and a rear position;

a backrest connected to the rear side of the seat;

a footrest unit movable between a storage position and an extended position spaced from the storage position in the forward/rearward direction, with the footrest unit including at least one first link, at least one second link, a first pivotal frame, a third link, a second pivotal frame, at least one fourth link, and at least one connection frame, with each of the at least one first link and the at least one second link pivotably connected to a front end of the front supporting portion, with a front side of the first pivotal frame in the storage position pivotably connected to the at least one first link, the at least one second link, and the front side of the seat, with a front end of the third link in the storage position pivotably connected to the front side of the seat, with a rear side of the second pivotal frame in the storage position pivotably connected to a rear side of the first pivotal frame and a rear end of the third link, with a rear end of the at least one fourth link in the storage position pivotably connected to the rear side of the first pivotal frame, with a front side of the at least one connection frame in the storage position pivotably connected to a front side of the second pivotal frame, and with a rear side of the at least one connection frame in the storage position pivotably connected to a front end of the at least one fourth link;

wherein forward movement of the seat causes the at least one first link and the at least one second link to pivot and causes the footrest unit to fold and move to the storage position below the seat, and the at least one first link and the at least one second link form a folded part of the footrest unit, and wherein rearward movement of the seat causes the at least one first link and the at least one second link to pivot and extend and causes the footrest to extend and move to the extended position in front of the seat.

2. The leisure chair with a footrest unit as claimed in claim 1, with the front supporting portion of the base including two front posts, with each of the two front posts having a front end, with the at least one first link including two first links pivotably connected to the front ends of the two front posts, respectively, with the at least one second link including two second links pivotably connected to the front ends of the two front posts, respectively, with the first pivotal frame having a width in the width direction smaller than a spacing between the two front posts in the width direction, and with the second pivotal frame having a width in the width direction smaller than the width of the first pivotal frame.

3. The leisure chair with a footrest unit as claimed in claim 2, with each of the two front posts of the base having a length in the forward/rearward direction larger than a half of a length of the seat in the forward/rearward direction, and with the first pivotal frame having a length in the forward/rearward direction approximately equal to the length of each of the two front posts.

4. The leisure chair with a footrest unit as claimed in claim 1, further comprising two pivotal columns, with each of the two pivotal columns having an upper end and a lower end, with each of the two ends of the horizontal rod of the base including a pivotal seat pivotably connected to the lower end of one of the two pivotal columns, with each pivotal seat including a stop portion on a rear side thereof, with the stop portion of each pivotal seat limiting a rearward pivotal angle of one of the two pivotal columns, and with the upper end of each of the two pivotal columns pivotably connected to the rear side of the seat.

5. The leisure chair with a footrest unit as claimed in claim 4, further comprising at least one elastic element mounted between the seat and the base, with the at least one elastic element providing a returning force for returning the seat to the front position.

6. The leisure chair with a footrest unit as claimed in claim 1, with the backrest pivotably connected to the seat, and with a telescopic rod mounted between the backrest and the seat to permit control of a rearward inclination angle of the backrest.

7. The leisure chair with a footrest unit as claimed in claim 1, with the front supporting portion of the base including two front posts, with each of the two front posts of the base having a length in the forward/rearward direction larger than a half of a length of the seat in the forward/rearward direction, with each of the two front posts including a front end having a first pivotal portion and a second pivotal portion spaced from the first pivotal portion in a vertical direction perpendicular to the forward/rearward direction and the width direction, with the front rod of the seat including two fourth pivotal portions, with the front rod further including a seventh pivotal portion, with the at least one first link of the footrest unit including two first links pivotably connected to the front ends of the two front posts, respectively, with each of the two first links including two ends respectively having an eleventh pivotal portion and a twelfth pivotal portion, with each eleventh pivotal portion pivotably connected to one of the two second pivotal portions of the base, with each twelfth pivotal portion pivotably connected to one of the fourth pivotal portions of the seat, with the at least one second link of the footrest unit including two second links pivotably connected to the front ends of the two front posts, respectively, with each of the two second links including two ends respectively having a thirteenth pivotal portion and a fourteenth pivotal portion, with each thirteenth pivotal portion pivotably connected to one of the first pivotal portions of the base, with the first pivotal frame of the footrest unit having a width in the width direction smaller than a spacing between the two front posts in the width direction, with the first pivotal frame including two first lateral beams parallel to each other and a first horizontal beam extending between the two first lateral beams, with each of the two first lateral beams having a length in the forward/rearward direction approximately equal to of the length of each of the two front posts, with the two first lateral beams symmetric to each other, with each of the two first lateral beams in the storage position including fifteenth, sixteenth, seventeenth, and eighteenth pivotal portions arranged in sequence from a front end thereof to a rear end thereof spaced from the front end in the forward/rearward direction, with each fifteenth pivotal portion pivotably connected to one of the fourth pivotal portions of the seat and the twelfth pivotal portion of one of the two first links, with each sixteenth pivotal portion pivotably connected to the fourteenth pivotal portion of one of the two second links, with the third link in the storage position including a nineteenth pivotal portion at the front end thereof and a twentieth pivotal portion at the rear end thereof, with the nineteenth pivotal portion pivotably connected to the seventh pivotal portion of the seat, with the second pivotal frame including two second lateral beams parallel to each other and a second horizontal beam connected between two ends respectively of the two second lateral beams, with the second pivotal frame having a width in the width direction smaller than a spacing between the two first lateral beams of the first pivotal frame in the width direction, with each of the two second lateral beams in the storage position including a front end having a twenty-first pivotal portion and a second end having a twenty-second pivotal portion, with the second horizontal beam including a twenty-third pivotal portion, with each twenty-second pivotal portion pivotably connected to one of the seventeenth pivotal portions of the first pivotal frame, with the twenty-third pivotal portion pivotably connected to the twentieth pivotal portion of the third link, with the at least one fourth link including two fourth links, with each of the two fourth links in the storage position including a front end having a twenty-fourth pivotal portion and a rear end having a twenty-fifth pivotal portion, with each twenty-fourth pivotal portion pivotably connected to one of the eighteenth pivotal portions of the first pivotal frame, and with the at least one connection frame including two connection frames, with each of the two connection frames in the storage position including a front end having a twenty-sixth pivotal portion and a rear end having a twenty-seventh pivotal portion, with each twenty-sixth pivotal portion pivotably connected to one of the twenty-first pivotal portions of the second pivotal frame, and with each twenty-seventh pivotal portion pivotably connected to the twenty-fifth pivotal portion of one of the two fourth links.

8. The leisure chair with a footrest unit as claimed in claim 7, further comprising two pivotal columns, with each of the two pivotal columns having an upper end and a lower end, with a sideboard mounted to each of the two ends of the horizontal rod of the base, with each armrest adapted to be mounted to one of the sideboards of the base, with each of the two ends of the horizontal rod of the base including a pivotal seat having a compartment and a third pivotal portion, with the lower end of each of the two pivotal columns pivotably connected to the third pivotal portion of one of the pivotal seats, with each pivotal seat including a stop portion on a rear side thereof, with the stop portion of each pivotal seat limiting a rearward pivotal angle of one of the two pivotal columns, with each of the two lateral rods of the seat including a fifth pivotal portion pivotably connected to the upper end of one of the two pivotal columns, wherein when the seat moves forwards, the front side of the seat presses against the two front posts of the front supporting portion, and the two pivotal columns are substantially perpendicular to the ground, and wherein when the seat moves rearwards, the two pivotal columns abut against the stop portions.

9. The leisure chair with a footrest unit as claimed in claim 8, further comprising at least one elastic element mounted to the seat and the base, with the at least one elastic element providing a returning force for returning the seat to the front position.

10. The leisure chair with a footrest unit as claimed in claim 9, with the at least one elastic element including two springs, with each of the two lateral rods of the seat including a peg in front of one of the fifth pivotal portions, with each of the two springs including two ends mounted to one of the pegs of the seat and one of the sideboards of the base.

* * * * *